United States Patent [19]

York

[11] 4,041,731

[45] Aug. 16, 1977

[54] PATTERNING UNITS FOR CIRCULAR KNITTING MACHINES

[75] Inventor: Herbert York, Great Glen, England

[73] Assignees: Kroy Knitting Developments Ltd.; B.Y. (Simulated Furs) Limited, both of Kent, England

[21] Appl. No.: 641,173

[22] Filed: Dec. 16, 1975

[30] Foreign Application Priority Data

Dec. 24, 1974 United Kingdom ..... 55798/74

[51] Int. Cl.[2] ..... D04B 15/74

[52] U.S. Cl. ..... 66/50 B

[58] Field of Search ..... 66/50 A, 50 B, 9 B

[56] References Cited

U.S. PATENT DOCUMENTS

| | | | |
|---|---|---|---|
| 1,896,635 | 2/1933 | Lombardi | 66/50 B |
| 2,094,660 | 10/1937 | Lombardi | 66/50 A |
| 2,262,213 | 11/1941 | Tandler | 66/50 B |
| 2,611,253 | 9/1952 | Diem | 66/50 B |
| 3,145,548 | 8/1964 | Mishcon | 66/50 A |
| 3,290,898 | 12/1966 | Schaeder et al. | 66/50 A |
| 3,416,332 | 12/1968 | Joseph | 66/50 B |
| 3,899,899 | 8/1975 | Bartel | 66/50 A |

FOREIGN PATENT DOCUMENTS

| | | | |
|---|---|---|---|
| 494,214 | 5/1954 | Italy | 66/50 B |

*Primary Examiner*—Mervin Stein
*Assistant Examiner*—A. M. Falik
*Attorney, Agent, or Firm*—Larson, Taylor and Hinds

[57] ABSTRACT

A patterning unit for a circular knitting machine which comprises an outer cylindrical pattern drum which is axially tricked around its periphery, the tricks being circumferentially spaced apart at the same pitch as the knitting instruments in the cylinder of a knitting machine with which the unit is to be associated, the drum being rotatable about its axis, a plurality of individually slidable selector elements arranged to function within predetermined ones only of the axial tricks in accordance with patterning requirements and, housed within the rotatable outer drum, a relatively fixed core-like inner component of cylindrical form and surrounded by a suitably contoured cam formation adapted, by cooperation with complementary formations on the selector elements, to impart to the latter sliding movements to and fro within the tricks.

4 Claims, 2 Drawing Figures

PATTERNING UNITS FOR CIRCULAR KNITTING MACHINES

Figure 1:
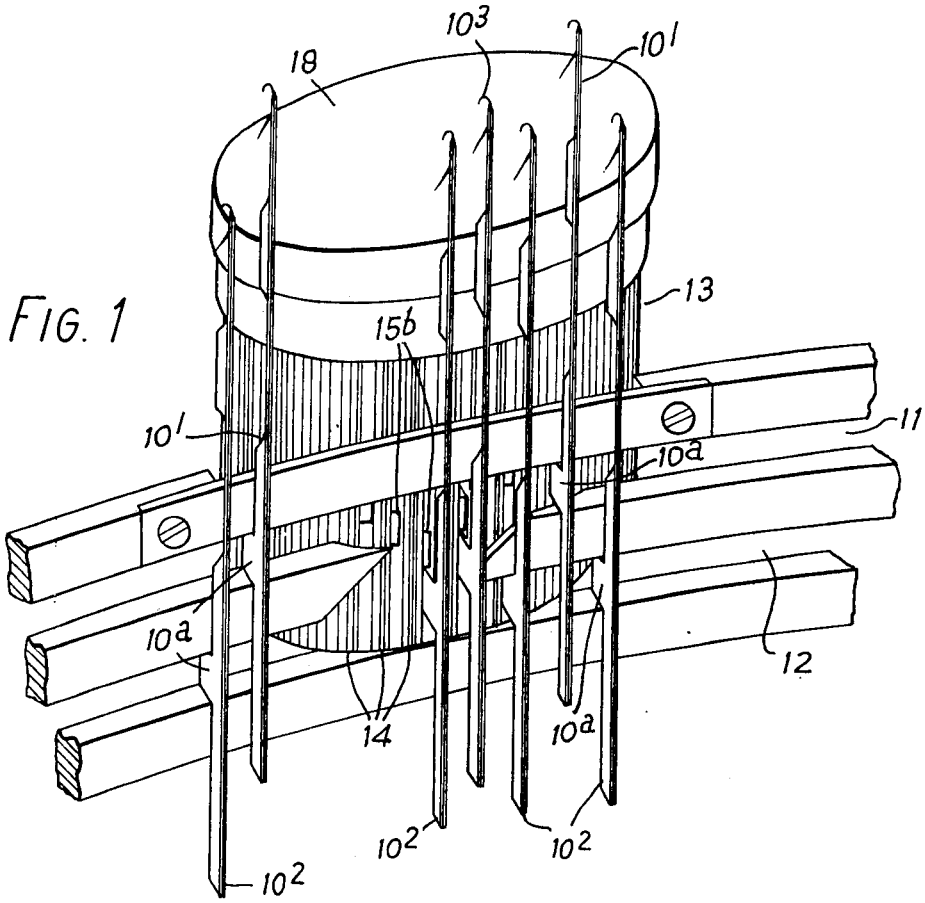

This invention relates to patterning units for circular knitting machines.

More particularly, the invention has reference to a patterning unit for a circular knitting machine of the kind comprising a peripherally tricked rotary component which is arranged to be rotated at a linear speed corresponding to the rotational speed of the knitting head of the circular knitting machine, adjacent to a correspondingly tricked cylinder containing knitting instruments to be controlled for patterning, tricks in the said rotary component having therein selector elements set out in a prearranged manner dictated by the required pattern and are adapted, by action upon selected knitting instruments as the component rotates, to move such instruments from one position to another, according to knitting requirements.

The knitting instruments in the needle cylinder may be knitting needles, needle-actuating or/and controlling jacks, with or without associated loop-expanding implements, and so on.

Heretofor, a patterning unit of the kind concerned has commonly consisted of an appropriately tricked inclined pattern wheel, that is to say a wheel the rotational axis of which is inclined with respect to the axis of the needle cylinder, and in predetermined tricks of which are accommodated relatively fixed selector elements or bits. Accordingly, as the inclined wheel revolves, the fixed elements or bits as a matter of course alternately rise seriatim from a low level to a higher level and thereupon descend from the latter to the original low level, and so on continuously, any knitting instrument contacted by the elements being automatically moved from one position, e.g. track, to another. In fact, with an inclined pattern wheel, in use, knitting instruments in the cylinder acted upon by selector elements or bits fixed in the wheel are conventionally always lifted by these elements or bits whilst the latter are rising, the said elements or bits thereupon descending idly to their low starting level preparatory to rising again for action upon further knitting instruments of a circular series. The fixed selector elements or bits act either upon butts on, or any other suitable parts of, the knitting instrument to be controlled for patterning.

One of the disadvantages of a conventional inclined pattern wheel is that it is insufficiently positive in so far as it has a tendency to lift unselected needles, i.e., needles intended to be left down at a low level.

Another disadvantage of such an inclined pattern wheel is that, by virtue of the very manner in which it functions, it necessarily has to be of such a size that it takes up a substantial amount of room adjacent to the needle cylinder with which it is associated.

The general object of the present invention is to provide an improved form of patterning unit of the kind herein referred to designed not only to overcome the foregoing disadvantages but also to provide additional positive advantages hereinafter to be described.

A particular aim of the invention is to provide such improved patterning units which are eminently suitable for application to multi-feed circular knitting machines for producing so-called high pile fabric, i.e., fabric comprising a knitted ground structure having loose fibres incorporated into the knitted loops thereof so as to form tufts at one side of the fabric, the pile formed by the said fibres being often treated to produce a fleecy or fur-like effect.

Broadly considered, the improved patterning unit of this invention comprises an outer cylindrical pattern drum which is axially tricked around its periphery, the tricks being circumferentially spaced apart at the same pitch as the knitting instruments in the cylinder of a knitting machine with which the unit is to be associated, and the drum being rotatable about its axis, a plurality of individually slidable selector elements arranged to function within predetermined ones only of the axial tricks in accordance with patterning requirements and, housed within the rotatable outer drum, a relatively fixed core-like inner component of cylindrical form and surrounded by a suitably contoured cam formation adapted, by co-operation with complementary formations on the selector elements, to impart to the latter sliding movements to and fro within the tricks.

With the improved patterning unit in use adjacent to a cylinder of a circular knitting machine, the axis of the unit about which the outer axially tricked cylindrical drum rotates is parallel to the knitting instruments in the cylinder which are to be controlled by the unit for patterning. In contradistinction, the axis of rotation of an inclined pattern wheel is inclined with respect to the knitting instruments to be controlled.

Assuming that the improved patterning unit is used to produce straight designs, then the width of the pattern is equal to the number of axial tricks around the outer cylindrical pattern drum and this number of tricks is some factor of the total number of tricks in the needle cylinder. The rotating outer cylindrical drum has the same linear speed as the rotary knitting head of the circular knitting machine, and where selector elements are placed in tricks in the rotary outer cylindrical pattern drum and are caused, by co-operation with a curved portion of the aforementioned relatively stationary contoured cam formation, to slide in those tricks, corresponding, i.e., selected, knitting instruments in the cylinder will be shifted from one position to another, according to knitting and patterning requirements. But where tricks in the outer cylindrical pattern drum are left empty, i.e., devoid of slidable selector elements, the corresponding non-selected knitting instruments will be left where they are.

Accordingly, in a multi-feed machine, each patterning unit makes one row of the pattern, and the depth of the pattern corresponds to the number of feeds around the cylinder.

In some fabrics, however, the number of feeds required to make one complete course might be greater than one, in which instance the pattern depth would be the number of feeds required to make one row of the pattern. The patterns just described are straight; that is, each pattern area is a rectangle, with a free and independent selection within the area. But the patterns may be limited in depth and by making the number of tricks around the patterning units a non-factor of the number of cylinder tricks, a wide range of bias patterns can be made either with rectangular pattern areas or areas with irregular shapes. For multi-feed machines the depth of pattern is multiplied by the number of feeds. Irregular shapes are obtained if the width of the design is not exactly divisible into the number of knitting instruments in the cylinder.

In the more usual case where an improved patterning unit of this invention is applied to a circular knitting machine of the rotary needle cylinder type, the unit will be mounted at a stationary location and the tricked outer cylindrical drum will be rotated at the same linear speed as the cylinder. But where, as may be, such a unit is applied to a machine of the rotary cam box type in which the cylinder is stationary, then the unit would be mounted on a part of or combined with the cam box so as to rotate bodily therewith, in which case the tricked outer cylindrical drum would be rotated at the same linear speed as the cam box.

In any event, the slidable selector elements are set out in the tricks in the rotary outer cylindrical drum in a predetermined manner dictated by the required pattern area and the relative sizes (diameterwise) of the cylinder and the patterning unit. Thus, as will be appreciated, some of the tricks in the outer cylindrical drum will have therein selector elements and others will be left empty, the interspersion of the elements in the tricks being a matter of judicious predetermination.

Preferably, the contoured cam formation surrounding the fixed core-like inner component of the improved patterning unit is in the form of a grooved channel or track having a curved portion which faces and is coincident with the nearest point of the adjacent cylinder, in which case each of the slidable selector elements accommodated in a trick in the outer cylindrical drum is formed with an inwardly directed butt which complementarily engages in the grooved channel or track. There is, however, no limitation in this respect, since, alternatively, the contoured cam formation may be in the form of a protuberant rib for engagement in complementary recesses formed in the inner edges of the slidable selector elements.

Again, depending on whether the curved portion of the contoured cam formation surrounding the relatively fixed inner component of the unit is downwardly directed or upwardly directed, the slidable selector elements can be either positively raised to lift selected needles or other knitting instruments from a low position or track to a higher position or track or positively depressed to lower selected needles or other knitting instruments from a higher position or track to a relatively low position or track. In the first case, the rising selector elements would act on the lower edges of butts on corresponding instruments, whereas in the second case the descending selector elements would act on upper edges of such butts.

Butts on the knitting instruments, for example the same butts as those specified in the last preceding paragraph may be relied on, since they are in intermeshing relationship with the tricks in the outer cylindrical drum, to rotate the latter at the same linear speed as the cylinder.

Thus, an important advantage of such an arrangement is that every needle (or other knitting instrument) in the machine can co-operate with the tricked outer cylindrical drum, to rotate it, even when some of the needles have been left in one position or track whilst others have been selectively shifted by the unit to another position or track.

Alternatively, the said outer cylindrical drum may be gear driven from any convenient part of the knitting machine.

Figure 2:
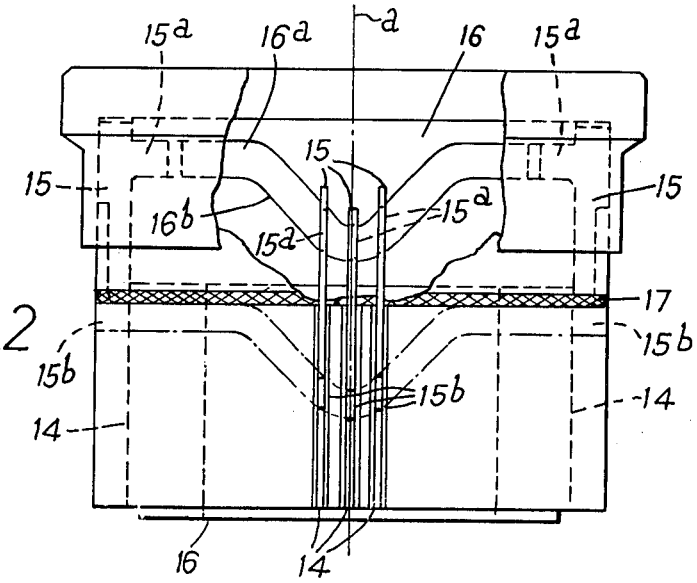

The invention will now be described further by way of example with reference to the accompanying diagrammatic sketches, wherein:

FIG. 1 is a general perspective view of a patterning unit in accordance with the invention, and FIG. 2 is an elevational view of the patterning unit of FIG. 1, with a portion of the rotatable outer cylindrical drum broken away to show the operative portion of the contoured cam track formed in and around the relatively stationary inner component.

Thus, in FIG. 1 of the drawings, the knitting instruments being controlled for patterning are latch needles, those of the needles shown with their operating butts 10*a* in an upper cam track 11 being designated 10[1]; those with their butts 10*a* in a lower cam track being designated 10[3].

Both in FIGS. 1 and 2 the illustrated parts of the patterning unit are designated as follows:

13 the outer cylindrical drum
14 axial tricks in the drum 13
15 slidable selector elements in 14
15*a* inwardly directed butts on 15
15*b* lower outwardly directed butts formed on 15
16 stationary core-like inner component
16*a* contoured cam track in 16 to receive 15*a*
16*b* downwardly directed curved portion of 16*a*
17 circular coiled spring to retain 15 in 14
18 cap surrounding and closing upper end of unit *a* axis of rotation of 13

Although the improved patterning unit is applicable to any appropriate circular knitting machine for producing various patterning effects of any desired character, it is principally the intention, as previously mentioned, and in accordance with an important aspect of the present invention, to apply the unit to multi-feed circular 'sliver' weft knitting machines specially designed for producing so-called high pile fabrics the pile fibres of which present a fleecy or fur-like effect.

In such a multi-feed sliver weft knitting machine there is provided at each feed a yarn guide for feeding to cleared needles a spun yarn and, at least one card station in advance of each feed, a card unit or head for feeding a sliver or slivers of loose fibres to required needles.

Each such card unit or head is usually of the type comprising a driven doffing cylinder having its periphery covered with brush-like tines and adapted to convey at least one sliver of fibres to raised needles, a rear similarly tinecovered card wheel or 'swift' which conveys the sliver or slivers to the doffing cylinder, and feed means for spreading out and delivering the one or more slivers from a supply or supplies to the rear card wheel or swift. Sometimes the latter is dispensed with in which instance the doffing cylinder is the only card wheel in the unit or head, being wholly relied on to feed a sliver or slivers of loose fibres to raised needles of the machine. As to the feed means, these conventionally consist of a plurality of pairs of axially ribbed feed rollers between the nips of which the sliver or slivers passes or pass, the respective pairs of such rollers being driven, through gearing, at different speeds as to spread out and stretch the fibres. Alternatively, and in accordance with a recent proposal, the said feed means may consist of a driven endless feed belt the external surface of which is covered with brush-like tines, means such as another similar belt being arranged in co-operation with the feed belt to perform a combing action on fibres in the course of their delivery to the doffing cylinder or the relevant card wheel, as the case may be.

Accordingly, the idea is that a patterning unit of the hereinbefore described improved form shall be provided at each card station of a multi-feed sliver weft knitting machine for the purpose of either lowering selected needles to withdraw same from the relevant card unit or head and thereby prevent these needles from collecting a fed sliver or slivers of loose fibres, or selectively raising needles to enable the latter to collect a sliver or slivers fed to such card unit or head, the arrangement in either case enabling high pile fabrics simulating animal pelts or furs to be variously patterned.

Patterning units constructed and operable according to this invention are particularly advantageous in multi-feed circular knitting machines such, for instance, as sliver weft knitting machines, in so far as such units occupy substantially less space around the needle cylinder than would, say, inclined pattern wheels. In this regard the improved units may be of as little as 2 inches in diameter.

What is claimed is:

1. In combination a patterning unit and a circular knitting machine having a rotatable needle cylinder, the patterning unit comprising an outer cylindrical pattern drum which is axially tricked around its periphery, the tricks being circumferentially spaced apart at the same pitch as the knitting instruments in the needle cylinder of the knitting machine, the drum being rotatable about an axis which is paralled to the knitting instruments in the cylinder, by way of all the needles in the needle cylinder which engage in tricks of the drum, a plurality of individually slidable selector elements arranged to function within predetermined ones only of the axial tricks in accordance with patterning requirements, a relatively fixed core-like inner component of cylindrical form housed within the rotatable outer drum, a suitably contoured cam formation surrounding said core-like inner component and adapted, by co-operation with complementary formations on the selector elements, to impart to the latter axially directed sliding movements to and fro within the tricks, the slidable selector elements being set out in the tricks in the rotary outer cylindrical pattern drum in a predetermined manner dictated by the required pattern area and the relative sizes of the knitting machine needle cylinder and the patterning unit itself.

2. A patterning unit as set forth in claim 1 wherein said contoured cam formation is in the form of a grooved channel or track having a curved portion which, in use, faces and is coincident with the nearest point of the adjacent cylinder of a knitting machine, each of the slidable selector elements accommodated in a trick in the outer cylindrical drum being formed with an inwardly directed butt which complementarily engages in the grooved channel or track.

3. A patterning unit as set forth in claim 1 wherein when the curved portion of the contoured cam formation is downwardly directed the rising selector elements act on the lower edges of butts on the corresponding knitting instruments.

4. A patterning unit as set forth in claim 1 wherein when a curved portion of the contoured cam formation is upwardly directed the descending selector elements act on the upper edges of butts on the corresponding knitting instruments.

* * * * *